US007037010B2

(12) United States Patent
Untersteller et al.

(10) Patent No.: US 7,037,010 B2
(45) Date of Patent: May 2, 2006

(54) THERMAL PRINTER

(75) Inventors: Jean-Marc Untersteller, Saint-Cyr sur Morin (FR); Eric Pallier, Viry-Chatillon (FR)

(73) Assignee: Axiohm, Montrouge . (FR)

( * ) Notice: Subject to any disclaimer, the term of this patent is extended or adjusted under 35 U.S.C. 154(b) by 0 days.

(21) Appl. No.: 11/010,371

(22) Filed: Dec. 14, 2004

(65) Prior Publication Data

US 2005/0135858 A1 Jun. 23, 2005

(30) Foreign Application Priority Data

Dec. 23, 2003 (FR) ..... 03 15233

(51) Int. Cl.
*B41J 2/315* (2006.01)

(52) U.S. Cl. ..... 400/120.01; 400/124.11; 400/124.12; 400/124.16; 347/171; 347/222

(58) Field of Classification Search ..... 400/120.01, 400/124.11, 124.12, 124.16; 346/145; 347/171, 347/222

See application file for complete search history.

(56) References Cited

U.S. PATENT DOCUMENTS

| | | | | |
|---|---|---|---|---|
| 5,309,181 | A | 5/1994 | Ota et al. | |
| 5,570,121 | A | 10/1996 | Mistyurik et al. | |
| 6,464,416 | B1 * | 10/2002 | Aoshima | 400/120.01 |
| 6,604,876 | B1 * | 8/2003 | Bryant et al. | 400/208 |

FOREIGN PATENT DOCUMENTS

| | | |
|---|---|---|
| FR | 2708523 | 2/1995 |

* cited by examiner

*Primary Examiner*—Andrew H. Hirshfeld
*Assistant Examiner*—Dave A. Ghatt
(74) *Attorney, Agent, or Firm*—Young & Thompson

(57) ABSTRACT

The thermal printer of the invention comprises a frame, a print head tiltably mounted in the frame, and a spring carried by the frame and forming a member for urging the print head into its printing position, with a flexible sheet of conductors terminating at the print head. According to the first characteristic of the invention, the spring is made of an electrically conductive material and includes a finger for being received in a corresponding orifice of the frame, while a portion of the sheet carries a conductive eyelet through which the finger of the spring passes when the spring is received in the orifice of the frame, the spring thus pinching the eyelet against the frame.

3 Claims, 1 Drawing Sheet

THERMAL PRINTER

The present invention relates to a thermal printer of the type possessing a roller acting to support and drive a print medium (a tape of heat-sensitive paper), the roller also serving to support a print head which is urged against a generator line of the roller (referred to as a capstan) and which rubs at this location against the paper via a row of hot points.

BACKGROUND OF THE INVENTION

Such devices are well known. The print head is formed by a ceramic plate associated with a metal radiator which is mounted on a frame to tilt or pivot about an axis parallel to the axis of the capstan, which is itself carried by the frame in bearings or half-bearings, either permanently if the printer is not openable, or else temporarily, solely when the printer is closed. A spring loaded between the frame and the print head presses the print head against a generator line of the capstan via its row of hot points situated in the vicinity of the edge of the plate opposite from its edge close to the tilt axis.

Friction between the print head and the paper traveling under its row of hot points generates electrostatic charge which accumulates in the head and which needs to be removed in order to avoid the charge disturbing print quality. Other charge can also be transferred to the head, as occurs in particular during contact between the head and the hand of an operator who happens to be carrying charge.

Electrical power and control of the hot points of the print head are provided via a flat conductor (ribbon cable) which also includes a ground conductor. This conductor serves in particular to connect the print head to the ground of the printer or of the apparatus in which the printer is included. Electrical contact between the print head and the ground wire of the ribbon cable is provided by any suitable means, for example a screw terminal installed in the radiator and onto which there is engaged a conductive eyelet that is electrically connected to the ground wire and that is held in place by a nut screwed onto the terminal. That type of assembly is lengthy and expensive to perform.

OBJECT OF THE INVENTION

The present invention seeks to simplify the structure and the assembly of a thermal printer.

BRIEF DESCRIPTION OF THE INVENTION

To this end, the invention thus provides a thermal printer comprising a frame, a print head tiltably mounted in the frame, and a spring carried by the frame and forming a member for urging the print head into its printing position, with a flexible sheet of conductors terminating at the print head. According to the first characteristic of the invention, the spring is made of an electrically conductive material and includes a finger for being received in a corresponding orifice of the frame, while a portion of the sheet carries a conductive eyelet through which the finger of the spring passes when the spring is received in the orifice of the frame.

By means of this disposition, electrical contact is provided between the spring and the ground conductor belonging to the electrical conductor sheet and connected to the above-mentioned eyelet, merely by mounting the spring on the frame. The spring is pressed against the eyelet which is pinched between the spring and the frame in the vicinity of the finger.

Preferably, the spring is a curved metal wire having one end constituting the above-mentioned finger, while its other end co-operates elastically with the frame to oppose the finger being disengaged from the orifice. The spring is thus in the form of a resilient clip with limbs on either side of the frame while nevertheless being capable of moving elastically away therefrom during assembly and disassembly in order to enable the finger to be received in the orifice of the frame, or on the contrary in order to enable it to be extracted therefrom.

More precisely, the spring is generally U-shaped, with the finger at the end of one of its limbs extending substantially parallel to the web of the U-shape, each of its limbs being received in a respective groove of the body so that only the web of the U-shape is elastically deformable in bending in a plane substantially perpendicular to the limbs.

Other characteristics and advantages of the invention appear from the following description given purely by way of indicative examples.

BRIEF DESCRIPTION OF THE DRAWING

Reference is made to the accompanying drawing, in which.

DETAILED DESCRIPTION OF THE INVENTION

Figures 1, 2, 3:
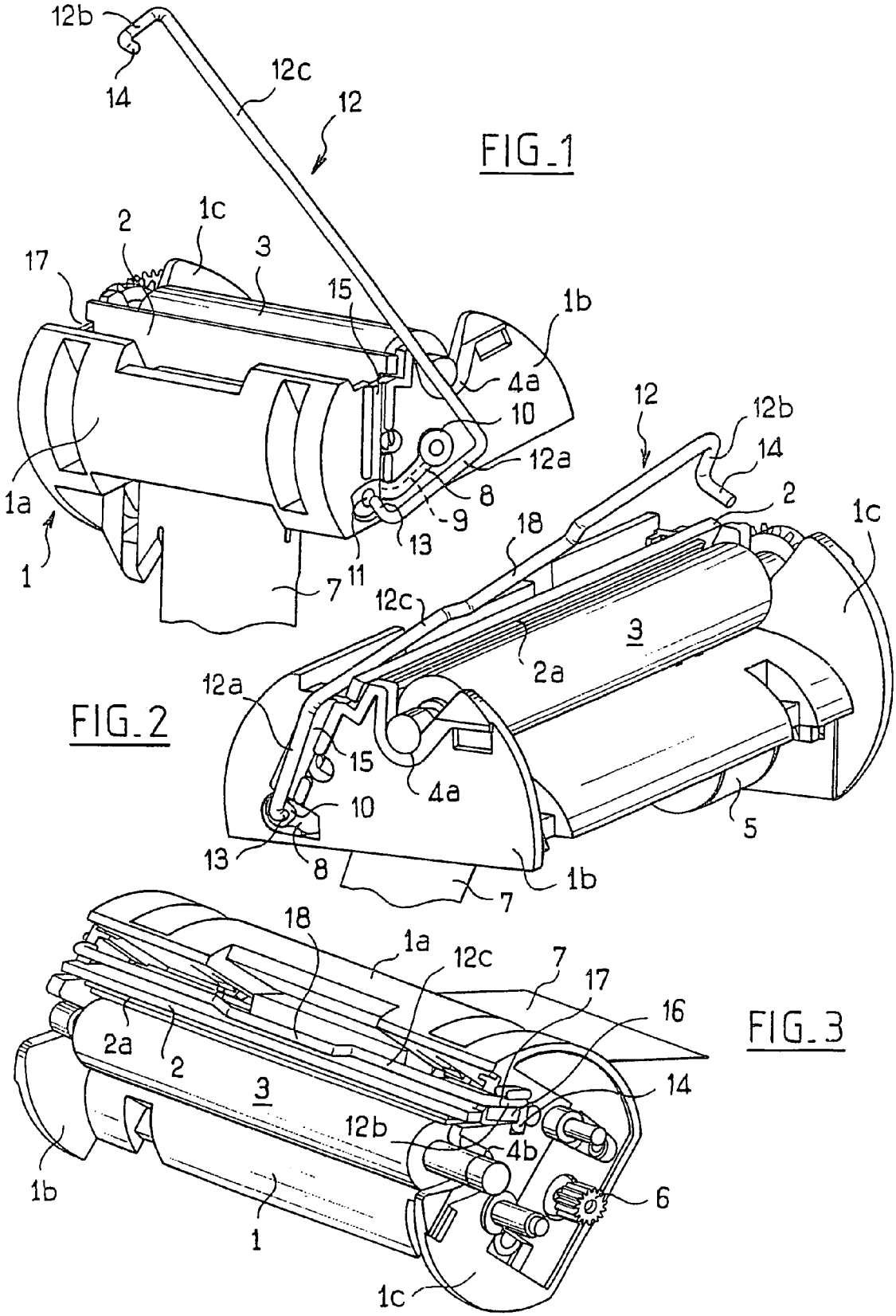
FIG. 1 is an outside view of a printer in accordance with the invention, prior to the spring being put into place.
FIG. 2 is a view similar to FIG. 1 while the spring is being put into place.
FIG. 3 shows the printer with the spring fully in place.

The embodiment shown in the figures relates to a thermal printer for printing tickets or receipts constituting proof that a transaction has taken place, for example. In this type of printer, it is known to use a frame 1, generally of plastics material, which roughly speaking comprises a cross-member 1*a* and two cheek pieces 1*b* and 1*c*. The frame supports a print head 2 capable of tilting through a small angle about an axis substantially parallel to the cross-member 1*a*. The print head has a row of hot points (not visible in the figures) which are pressed against a generator line of a support roller or capstan 3 that is received in support bearings 4*a* and 4*b* in the cheek plates 1*b* and 1*c* of the frame 1. This pressed position corresponds to the printing position of the printer. In reality, reference 2 is attached to a metal radiator of the print head, which head also includes a ceramic plate 2*a* carrying the row of hot points.

The frame 1 supports a motor 5 which is suitable for rotating the capstan 3 via a transmission including gears, with one gearwheel 6 being visible in FIG. 3. The capstan thus becomes means for driving the print medium under the print head 2.

A series of electrical conductors combined in a flexible sheet is referenced 7 in the figures. The conductors serve to supply electrical energy to the motor and to the hot points, and they also serve to control said hot points.

In accordance with the invention, this flexible sheet or ribbon 7 includes a tongue 8 carrying a conductor 9 which constitutes a ground wire, the tongue 8 being terminated by a metal eyelet 10 that is electrically connected to the ground conductor 9. The tongue 8 is taken from inside the frame 1 through a slot in the cheek plate 1*b* so as to enable it to be situated outside said cheek plate in order to enable it to be pressed against said cheek plate 1*b* of the frame 1. In this position, the opening in the eyelet 10 is in register with an orifice formed through the cheek plate 1*b* of the frame.

In order to keep the print head 1 in contact with the capstan 3, a return spring is used that is loaded between the head and the frame. In the configuration of the invention, the return spring is formed by a metal wire 12 in the form of a U-shaped clip that possesses a limb 12*a*, a limb 12*b*, and a cross-piece or web 12*c*. The limbs 12*a* and 12*b* are substantially parallel, the limb 12*a* having an end 13 extending perpendicularly to the limb and substantially parallel to the web 12*b* so as to constitute a finger suitable for being inserted into the eyelet 10 of the tongue 8 when the eyelet is placed facing the orifice 11. The limb 12*b* has an end 14 that is also bent, but is oriented in such a manner as to form a stud substantially perpendicular to the general plane of the spring as defined by its cross-member and its two limbs.

By inserting the finger 13 into the orifice 11, the spring 12 is put into the position shown in FIG. 2 and the limb 12*a* comes progressively to be received in an outside groove 15 of the cheek plate 1*b* of the frame 1. The cross-member 12*c* is then received behind the print head 2 by folding down the spring in such a manner that the finger 14 slides over a cam surface 16 which forces elastic deformation mainly of the limb 12*b*, thereby confirming insertion of the finger 13 in the orifice 11. Past the cam surface 16, the stud 14 snaps elastically against the cheek plate 1*c* of the frame 1 so that the limb 12*b* is received in an outwardly-open groove in the side of this cheek plate 1*c*, the groove being referenced 17 in FIG. 3, and the limb is prevented from moving longitudinally in the groove by co-operation between the stud 14 and the end of the cam 16.

It can be seen that the cross-member 12*c* of the spring is not rectilinear, but takes up a shape such that its central zone 18 constitutes a point where the cross-member is pressed forcibly behind the print head 2. In this way, it is elastic deformation in bending of the cross-member 12*c* that constitutes the return means for urging the print head 2 against the capstan 3. Any other curved shape for the spring in a plane substantially perpendicular to the plane containing the limbs 12*a* and 12*b* would be equivalent to the disposition shown.

The spring 12 thus provides electrical continuity between the print head 2 and the ground conductor 9, with this being done in a manner that is extremely simple without having recourse to complex fastener means of the kind known in the prior art. In this position, the portion of the limb 12*a* of the spring adjacent to the finger 13 bears against the eyelet 10 (which is constituted by a flat electrically conductive washer at the end of the tongue 8). If the hole in the eyelet is smaller in diameter than the orifice 11, there will even be deformation of the eyelet by the curve connecting the finger 13 to the limb 12*a*.

The invention is described above with reference to a particular print head. Naturally, the invention applies to any print head which, instead of using a presser roller 3, implements any support for heat-sensitive printing paper, and against which it is necessary to press the row of hot points elastically.

The invention applies to other printer embodiments (not shown) and in particular to other shapes for the spring that presses the print head against the support roller. A spring could be provided that is not in the form of a metal wire, but in the form of a bent wire blade, the blade being curved between the two cheek plates 1*b* and 1*c* of the frame, with one of the ends of the metal blade presenting a finger which enters into an orifice in said cheek plates in the manner described above after passing via an eyelet for electrically connecting the blade to a ground wire. Under such circumstances, the eyelet should be in register with an orifice such as 11 from the inside face of the corresponding cheek plate of the frame, the blade being braced between the two inside faces of the two plates.

The spring 12 may be made of composite material, for example a synthetic material covered in a metal coating.

It is also possible to provide for the eyelet 10 to be pellet having a break starter formed in the center thereof to allow the finger 13 to be forced therethrough.

What is claimed is:

1. A thermal printer comprising a frame, a print head tiltably mounted in the frame, and a spring carried by the frame and forming a member for urging the print head into its printing position, with a flexible sheet of conductors terminating at the print head, wherein the spring is made of an electrically conductive material and includes a finger for being received in a corresponding orifice of the frame, while a portion of the sheet carries a conductive eyelet through which the finger of the spring passes when the spring is received in the orifice of the frame, the spring thus pinching the eyelet against the frame.

2. A printer according to claim 1, wherein the spring is a curved metal wire having one end constituting the above-mentioned finger while its other end co-operates elastically with the frame to oppose the finger being disengaged from the orifice.

3. A printer according to claim 2, wherein the spring is generally U-shaped, with the finger at the end of one of its limbs, extending substantially parallel to the web of the U-shape, each of the limbs being received in a corresponding groove of the frame so that only the web of the U-shape is elastically deformable in bending in a plane substantially perpendicular to the limbs.

* * * * *